US010677479B2

(12) United States Patent
Andersson

(10) Patent No.: US 10,677,479 B2
(45) Date of Patent: Jun. 9, 2020

(54) DRAINAGE TRAY FOR A HEAT PUMP

(71) Applicant: CLIMACO HOLDING AB, Kristianstad (SE)

(72) Inventor: Mats Andersson, Önnestad (SE)

(73) Assignee: CLIMACO HOLDING AB, Kristianstad (SE)

( * ) Notice: Subject to any disclaimer, the term of this patent is extended or adjusted under 35 U.S.C. 154(b) by 111 days.

(21) Appl. No.: 15/760,043

(22) PCT Filed: Sep. 15, 2016

(86) PCT No.: PCT/SE2016/050869
§ 371 (c)(1),
(2) Date: Mar. 14, 2018

(87) PCT Pub. No.: WO2017/048186
PCT Pub. Date: Mar. 23, 2017

(65) Prior Publication Data

US 2018/0259200 A1 Sep. 13, 2018

(30) Foreign Application Priority Data

Sep. 15, 2015 (SE) ..... 1551178

(51) Int. Cl.
*F24F 1/36* (2011.01)
*F24F 11/41* (2018.01)
(Continued)

(52) U.S. Cl.
CPC ..... *F24F 1/36* (2013.01); *F24D 19/08* (2013.01); *F24F 11/41* (2018.01); *F24F 13/22* (2013.01); *F24F 13/222* (2013.01); *F24F 1/40* (2013.01); *F24F 1/60* (2013.01); *F24F 2013/227* (2013.01); *F24F 2221/34* (2013.01)

(58) Field of Classification Search
CPC .... F24F 1/36; F24F 13/22; F24F 11/41; F24F 1/40; F24F 1/60; F24F 2013/227; F24F 2221/34; F24F 13/222; F24F 11/42; F24D 19/08; F24H 9/16; F25D 21/14
See application file for complete search history.

(56) References Cited

U.S. PATENT DOCUMENTS 4,037,427 A * 7/1977 Kramer ..... F25D 21/02 62/128
4,416,327 A 11/1983 Nakada et al.
(Continued)

FOREIGN PATENT DOCUMENTS

CN 202581603 U 12/2012
CN 203489491 U 3/2014
(Continued)

*Primary Examiner* — Emmanuel E Duke
(74) *Attorney, Agent, or Firm* — Capitol City TechLaw

(57) ABSTRACT

A drainage tray for collecting condensate from a heat pump is disclosed, where the heat pump (3) being adapted to be mounted on a support (4) being mountable to at least one supporting structure to carry the weight of the heat pump (2) and the support (4) wherein the tray (2) comprises a peripheral and preferably inclined edge portion (7) defining a central recessed tray portion (8) configured to collect condensate, wherein the tray further comprises a condensate outlet (9) for removing the condensate from the tray (2).

22 Claims, 3 Drawing Sheets

(51) Int. Cl.

| | |
|---|---|
| ***F24F 13/22*** | (2006.01) |
| ***F24D 19/08*** | (2006.01) |
| *F24F 1/60* | (2011.01) |
| *F24F 1/40* | (2011.01) |

(56) References Cited

U.S. PATENT DOCUMENTS

| | | | | | |
|---|---|---|---|---|---|
| 4,893,481 | A * | 1/1990 | Sullivan | F24F 13/22 | 29/402.08 |
| 5,664,430 | A * | 9/1997 | Karman | F24F 13/22 | 62/285 |
| 6,125,647 | A * | 10/2000 | Martinez | E04D 13/08 | 62/285 |
| 2005/0034471 | A1 | 2/2005 | Shin | | |
| 2012/0193505 | A1 * | 8/2012 | Baron | F16F 15/06 | 248/636 |
| 2014/0131024 | A1 | 5/2014 | Iwazaki et al. | | |

FOREIGN PATENT DOCUMENTS

| | | | | |
|---|---|---|---|---|
| CN | 203719081 | U | 7/2014 | |
| EP | 2636966 | A1 * | 9/2013 | F24F 1/36 |
| EP | 2636966 | A1 | 9/2013 | |
| JP | 2008096018 | A | 4/2008 | |
| JP | 2012220170 | A | 11/2012 | |

* cited by examiner

DRAINAGE TRAY FOR A HEAT PUMP

This application claims priority under 35 USC 119(a)-(d) to SE patent application No. 1551178-5, which was filed on Sep. 15, 2015, the entire content of which is incorporated herein by reference.

TECHNICAL FIELD

The present invention relates to heat pumps for providing heating and/or cooling to a destination, more specifically for air source heat pumps for providing heating and/or cooling to a building or a part of a building, and even more specifically to a drainage tray for removing condensate which is produced by the heat pump.

BACKGROUND

Heat pumps are commonly used for providing heating or cooling to buildings, i.e. HVAC applications, due to their relatively low running costs and friendliness to the environment. Development has for several years been trending towards many households and business buildings switching from aging more expensive HVAC systems to a heat pump based system, such that the heat pump alone provides the heating or complements the older system.

Heat pumps use refrigeration cycles in which a refrigerant is used for collecting and delivering heat. The heat pumps may be reversible, i.e. the condenser and the evaporator may switch functionality.

Air source heat pumps generally comprise an outdoor unit. A known problem with this unit is that it generates a lot of condensate, and as development leads to more efficient heat pumps, even more condensate is produced. Many heat pumps lack a built in solution for taking care of the condensate, and therefore rely on external trays which are fitted below the heat pump. These are however sensitive to freezing of the condensate and to debris such as leaves clogging the outlet of the tray.

SUMMARY

It is an object of the teachings herein to provide a drainage tray for a heat pump which is improved over prior art, alleviating known problems thereof. This object is achieved by a concept having the features set forth in the appended independent claims; preferred embodiments thereof being defined in the related dependent claims.

According to a first aspect of the teachings herein, a drainage tray for collecting condensate from a heat pump is provided. The heat pump is adapted to be mounted on a support, said support being mountable to at least one supporting structure (such as the ground and/or an external building wall) to carry the weight of the heat pump and the support. The tray comprises a peripheral and preferably inclined edge portion defining a central recessed tray portion configured to collect condensate, and the tray further comprises a condensate outlet for removing the condensate from the tray. The tray is configured to be arranged between an underside of the heat pump and the support. Since the distance between the tray and the heat pump is minimized, the risk of freezing condensate, spilling of condensate and debris falling into the tray is reduced, and a tray which is improved over prior art is thereby provided.

According to one embodiment the drainage tray further comprises at least two lateral recessed portions on the opposite side of the tray in relation to the central recessed portion. The lateral recessed portions essentially correspond to supporting members on the support such that the tray is supported by the contact between the at least two lateral recessed portions and the support. The lateral recessed portions are shaped and positioned for securing the tray and preventing sideways motions in the longitudinal direction of the tray.

According to one embodiment, the at least two lateral recessed portions further comprise a rubber coating covering at least a part of the at least two lateral recessed portions for increasing friction between the tray and the support. The rubber coating provides dampening of any noise that might be caused by vibrations or by wind and increases the friction between the tray and the support.

According to one embodiment of the teachings herein, a first of the lateral recessed portions is adapted for restricting motion of the tray in two directions and a second of the lateral recessed portions is adapted for restricting motion of the tray in one direction. The different shape of the first and second recessed portions will facilitate insertion and removal of the tray and also provide larger dimensional span of the supports which support the tray will fit onto.

In one embodiment of the teachings herein, the drainage tray has an essentially trapezoidal shape in a horizontal plane, i.e. a plane parallel to the underside of the heat pump. The shape of the tray corresponds to the L-shaped condenser of many heat pumps. It is possible to adapt the tray according to shape of the condenser since the vicinity of the tray to the heat pump reduces the effect of wind or other external forces on the drops of condensate.

According to one embodiment, the drainage tray comprises a top tray portion and a bottom tray portion. The top and bottom portions are connected along a peripheral edge of the tray, and a hollow centre portion is formed within the tray between the top and bottom portions. The hollow centre portion provides an insulating air layer between the central recessed portion and the bottom portion which is in contact with the support.

In one embodiment an electrically heated sheet is arranged within the hollow portion, said sheet being attached to the underside of the top tray portion such that it evenly heats the central recessed portion of the tray avoiding freezing of the condensate. The heated sheet keeps the condensate from freezing and heats the central recessed portion and even at least a part of the inclined edge portion.

According to one embodiment, an insulating sheet is arranged within the hollow portion, said sheet being attached to the top side of the bottom tray portion. The insulating sheet increases the efficiency of the tray in combination with the electrically heated sheet.

In one embodiment of the teachings herein, the insulating sheet is spaced from the heating sheet within the hollow portion such that further insulation is provided by intermediate air between the insulating sheet and the electrically heated sheet.

According to one embodiment, the drainage tray is made from a polymer material, preferably ABS/PMMA.

In one embodiment of the teachings herein, a hose is connectable to the outlet of the tray, said hose being insulated and configured to be heated by an internal heating element.

In one embodiment, the recessed portion for collecting condensate is configured to hold a volume of at least 1.2 l condensate, and more preferably at least 1.4 l condensate. The volume of the central recessed portion provides a buffer volume which is beneficial if for instance if a blockage occurs in the outlet of the tray or in the hose.

In one embodiment, the drainage tray has a height of between 20 and 30 mm, preferably 25 mm.

In a second aspect of the teaching herein, a heat pump system is provided. The system comprising a heat pump, a support and a drainage tray according to the first aspect, wherein the heat pump is arranged on the support via bushings having a height of between 25 and 40 mm, more preferably between 30 and 35 mm and even more preferably 30 mm, said bushings creating a space between the underside of the heat pump and the support configured for receiving the tray.

BRIEF DESCRIPTION OF THE DRAWINGS

Embodiments of the teachings herein will be described in further detail in the following with reference to the accompanying drawings which illustrate non-limiting examples on how the embodiments can be reduced into practice and in which.

DETAILED DESCRIPTION OF EMBODIMENTS

Figure 1:
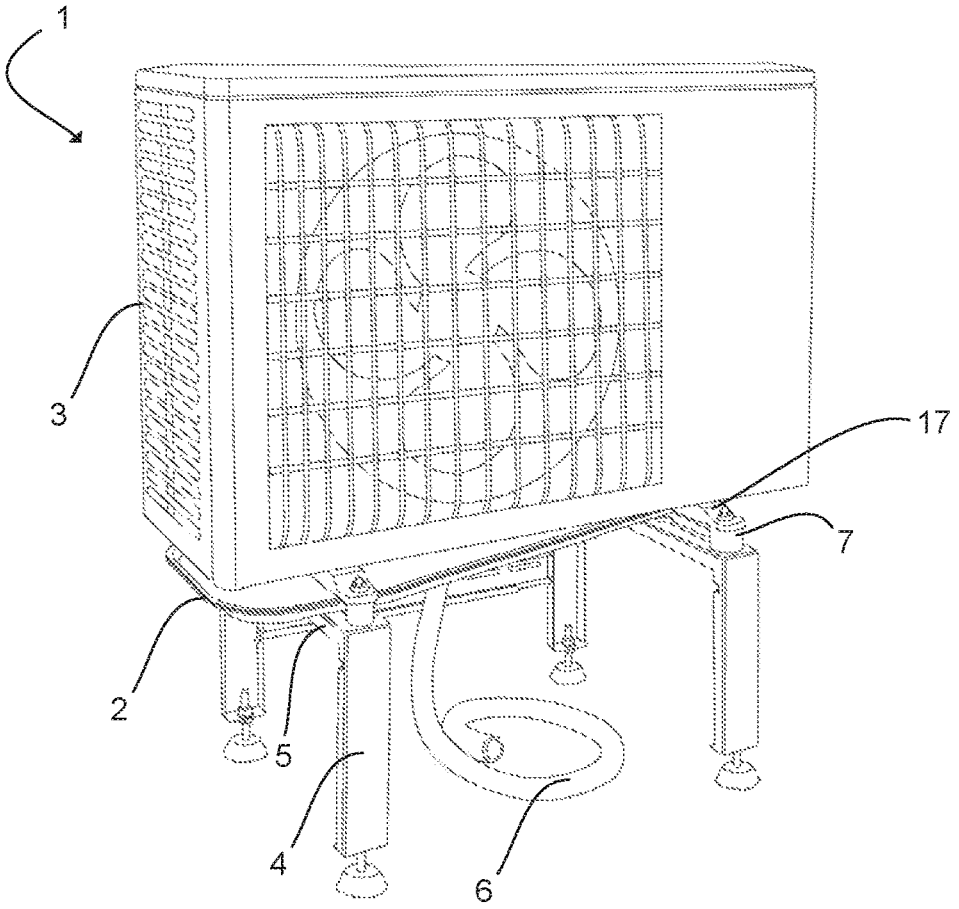
FIG. 1 shows a heat pump system according to one embodiment of the teachings herein.

With reference to FIG. 1, a heat pump system 1 is shown. The heat pump 3 is positioned on a support 4. The support is mounted to or resting on a supporting structure, in FIG. 1 this is the ground and an optional wall behind the support for further stability. The supporting structure is defined as the structure or structures which bear the load from the heat pump and the support. The support 4 could also be a wall mounted support, where the only supporting structure is a wall. The support 4 comprises a plurality of supporting members 5, onto which the heat pump 3 is mounted. The support 4 is preferably made out of metal, such as galvanized steel, stainless steel, aluminium or another metal with high corrosion resistance. Other materials are also possible, such as plastics or composite materials.

The heat pump 3 shown is an outdoor unit which is adapted to be connected to an indoor unit for providing heat or cooling and regulating the indoor climate.

The heat pump 3 may be mounted onto the support 4 via bushings 7 attached either directly to the underside of the heat pump 3 or to heat pump mounting feet 17 which are attached to the heat pump 3. The bushings 7 are made of a resilient material, such as rubber, and intended to absorb and reduce the risk of any possible vibrations in the heat pump 3 being transferred to the support 4 and onwards to the supporting structure. The bushings 7 have a height of between 25 and 40 mm, more preferably between 30 and 35 mm and even more preferably 30 mm. Thus a space is provided between the underside of the pump 3 or the mounting feet 17 of the pump and the support 4 which essentially corresponds to the height of the bushings 7.

The space between the pump 3 and the support 4 is adapted for receiving a drainage tray 2 according to the teachings herein. The drainage tray 2 is adapted to receive the condensate which is being produced by the pump 3 and which drips from drainage holes in the underside of the pump 3. By providing the space between the pump 3 and the support 4 and a drainage tray 2 adapted for being arranged in said space, the tray 2 can be brought closer to the underside of the pump 3. This is an advantage since it will reduce the falling distance for condensate drops from the pump 3, which reduces the risk of drops being affected by wind such that they fall to the side of the tray. The risk of condensate freezing during cold temperatures also decreases.

A small distance between the tray 2 and the underside of the pump 3 is also an advantage since it reduces the risk of debris such as leaves landing in the tray 3.

The tray further comprises a hose 6 for removing the condensate from the tray 2. The hose may comprise insulation and may furthermore be configured to be heated by a heating element, such as a heating cable, to ensure that the condensate does not freeze in the hose.

Figure 2:
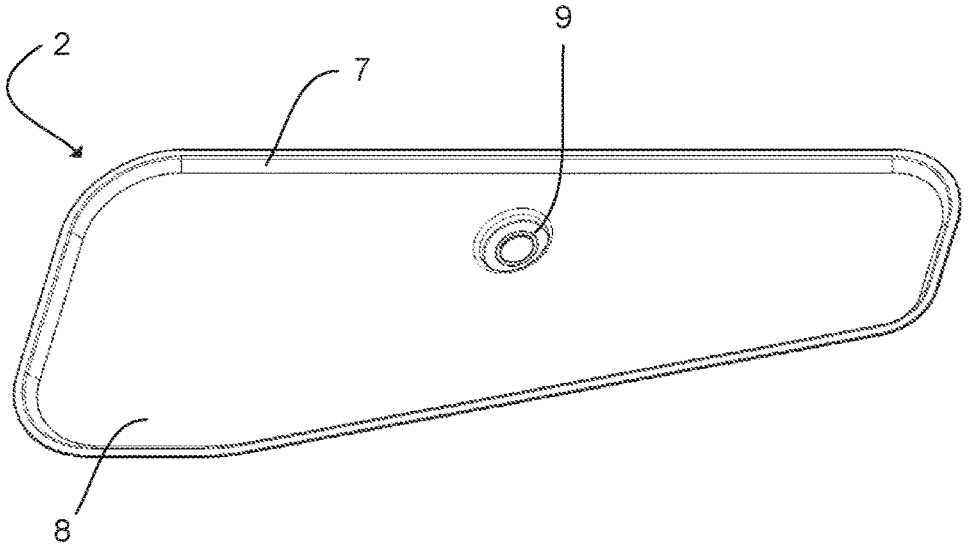
FIG. 2 shows a perspective view of a drainage tray according the teachings herein.

Turning to FIG. 2, a perspective view is shown of a drainage tray 2 according to the teachings herein. The tray 2 has an essentially trapezoidal, oblong shape in a horizontal plane i.e. in a plane parallel to the underside of the heat pump. The shape is however not limited to an ideal trapezoidal shape, as a rectangular portion may be arranged on the wider part of the trapezoidal. Many of the leading manufacturers of heat pumps use L-shaped condensers, when seen from above, which are positioned in the heat pumps 3 in similar manners. The shape of the tray 2 can thereby be optimized, as the drops will fall from the condenser through the holes in the underside of the pump 3 in an essentially L-shaped pattern. This is made possible by the tray 2 being brought closer to the pump 3, ensuring that the drops of condensate will fall straight down into the tray 2. An advantage with the optimized shape is the reduced manufacturing cost due to less material being required for the tray.

The tray 2 further comprises an outlet 9, through which the collected condensate drains. The hose 6 is connectable to the outlet 9 for instance by means of a threaded connection or a quick lock connection. The tray 2 also comprises a peripheral inclined edge portion 7 forming a central recessed tray portion 8. The inclined edge portion 7 prevents the condensate from spilling off the side of the tray, and the central recessed tray portion 8 which faces the underside of the pump 3 can hold a certain volume of condensate. This is beneficial since if a blockage occurs in the outlet 9 or in the hose 6, the recessed tray portion 8 will function as a buffering volume, providing a longer time span until condensate overflows the inclined edge portion 7. The volume of the central recessed portion 8 is at least 1.2 l in the disclosed embodiment, more preferably more than 1.4 l. The volume is preferably in the range of 1 l-1.6 l. The inclined edge portion 7 has an incline of approximately 35° to 55° in the disclosed embodiment or more preferably approximately 45° in relation the surface in the central recessed portion 8.

Figure 3:
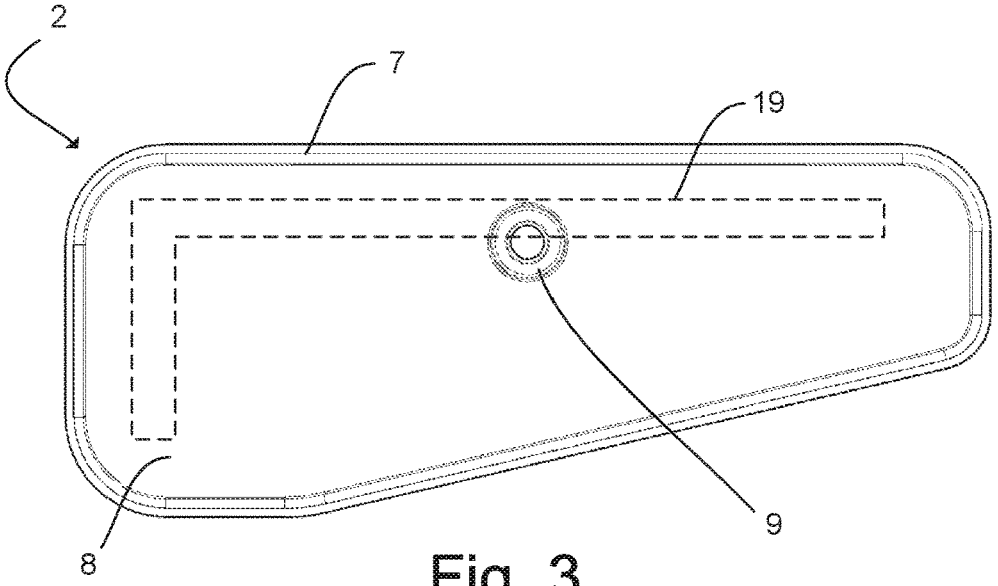
FIG. 3 shows a top view of a drainage tray according to the teachings herein.

In FIG. 3, the tray 2 is shown as seen from above with an outline 19 of a how the L-shaped condenser in a heat pump is oriented in relation to the tray 2. The shape of the tray 2 is optimized in relation to the condenser, thus using less material in the manufacturing of the tray 2 whilst maintaining or improving functionality.

Figure 4:
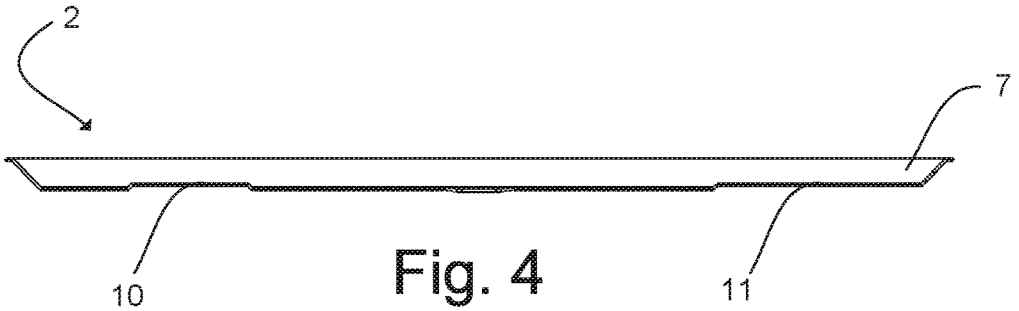
FIG. 4 shows a side view of a drainage tray according to the teachings herein.
Figure 5:
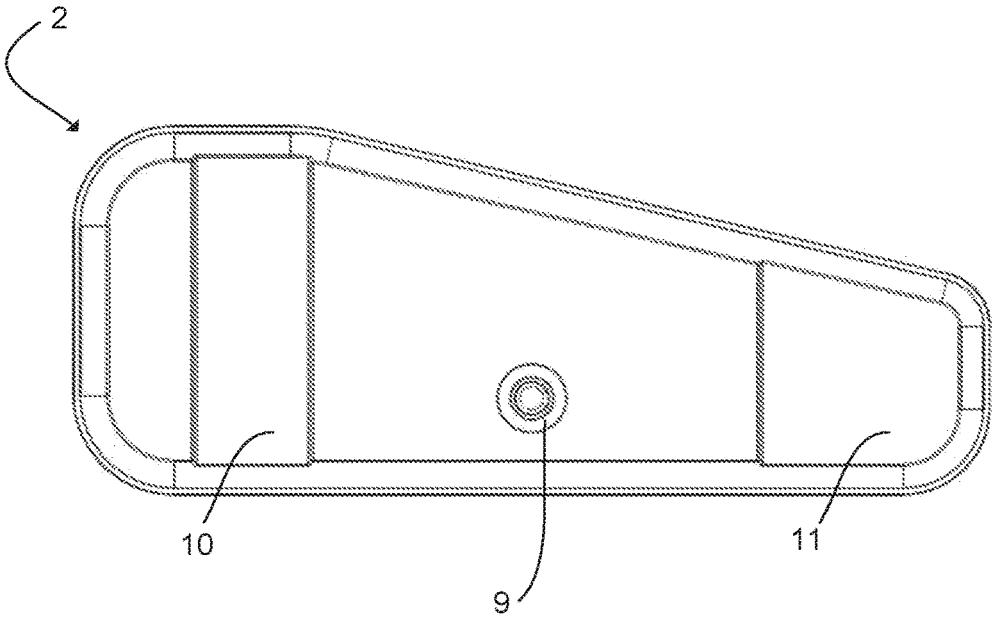
FIG. 5 shows a bottom view of a drainage tray according to the teachings herein.

In FIGS. 4 and 5, a side view and bottom view of the tray 2 are shown. The tray 2 has at least two lateral recessed portions 10, 11, which essentially correspond to the supporting members 5 on the support 4. The recessed portions 10, 11 are on the opposite side of the tray 2 in relation to the central recessed portion 8. As the tray 2 is placed on the support 4, the tray will rest on and be held in place by the contact between the portions 10, 11 and the support 4.

Furthermore, a first 10 of the lateral recessed portions is adapted for restricting motion of the tray in two directions, and a second 11 of the lateral recessed portions 10, 11 is adapted for restricting motion of the tray in one direction. This is possible since the first lateral recessed portion 10 comprises two edges being transverse to the longitudinal direction of the tray 2 while the second lateral recessed portion 11 only comprises one transverse edge that will limit the motion of the tray 2.

The support of the tray 2 may be further facilitated by provision of a rubber coating to the lateral recessed portions 10, 11. The rubber coating will provide increased friction between the tray 2 and the support 4, and also reduce any noise that the tray 2 may cause due to possible vibrations caused by moving parts in the pump 3. The rubber coating may be a rubber sheet which is applied by an adhesive such as glue or tape, i.e. laminated onto the tray 2. The rubber coating may also be applied in the manufacturing process of the tray 2, for instance as a part of a thermoforming or injection molding process.

The height of the tray 2 is between 20 mm and 30 mm in the disclosed embodiment, preferably approximately 25 mm such that it can fit between the pump 3 and the support 4.

Figure 6:
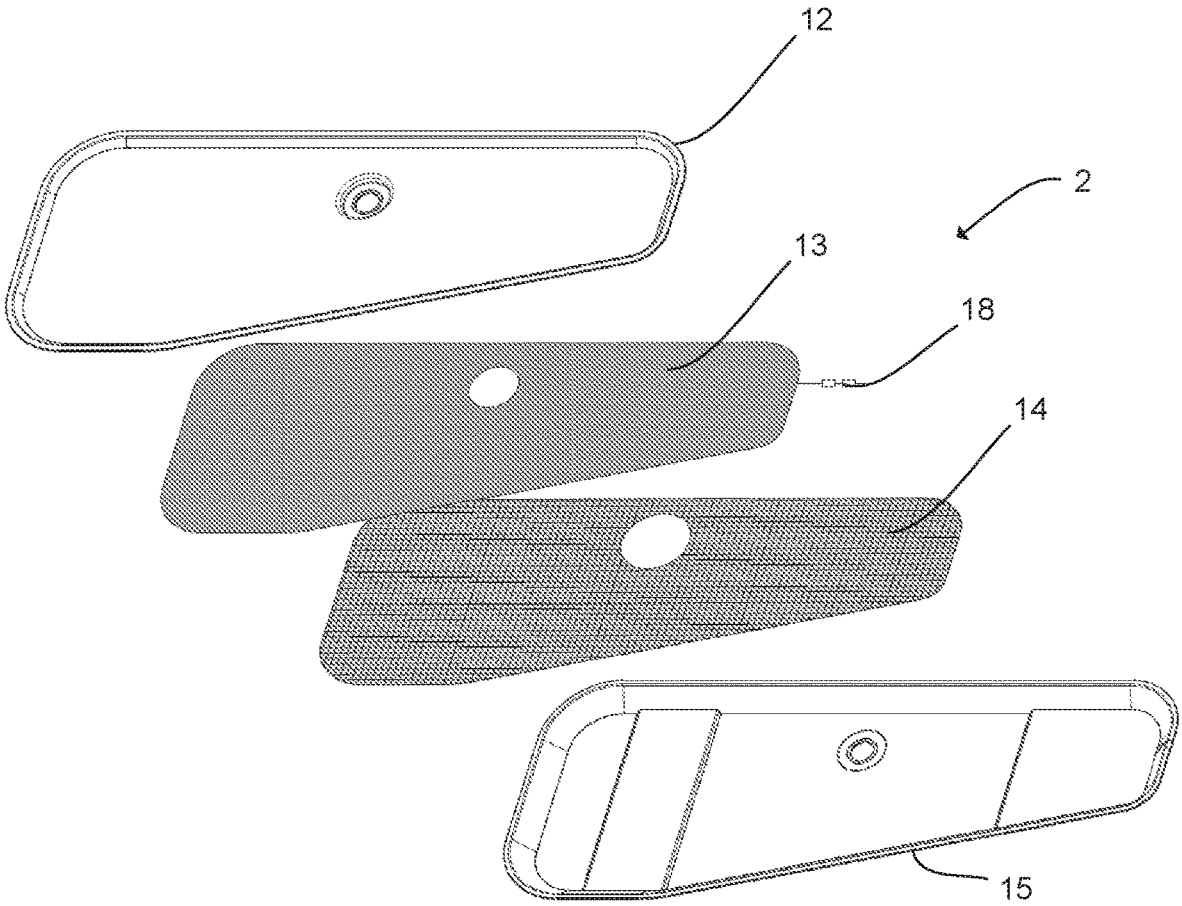
FIG. 6 shows an exploded view of a drainage tray according to the teachings herein.
Figure 7:
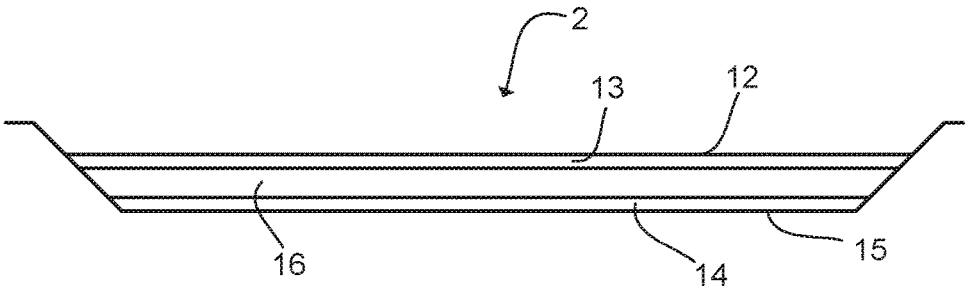
FIG. 7 shows a cross-sectioned view of a drainage tray according to the teachings herein.

With reference to FIGS. 6 and 7, the internal components of the tray 2 are shown. As can be seen, the tray 2 comprises a top portion 12 and a bottom portion 15. The top 12 and bottom 15 portions are connected along a peripheral edge of the tray 2, for instance by means of welding and/or gluing. The top and bottom portions 12, 15 may be manufactured in a thermoforming process or in an injection molding process. Other manufacturing processes are however also possible.

The top 12 and bottom 15 portions form between them a hollow portion 16, in which an insulating sheet 14 and/or a electrically heated sheet 13 may be arranged. The insulating sheet 14 is preferably arranged attached to the top side, i.e. the side facing the top portion 12, of the bottom portion 15. This may be achieved by gluing or by use of other adhesives such as tape. The insulating sheet has a thickness in the range of 2 to 6 mm, preferably 2 to 4 mm and more preferably 3 mm. The thickness of the insulating sheet may also be varied in relation to the surface area of the tray 2. As the surface area of the tray 2 increases, the need for a thicker insulating sheet 14 also increases. Thus, a small tray 2 may comprise an insulating sheet 14 with a thickness that is smaller than the thickness of an insulating sheet 14 for a larger tray 2.

The electrically heated sheet 13 comprises at least one electrically heated circuit which evenly distributes the heat over the surface area of the sheet 13 and onwards to the central recessed portion 8 of the tray 2. To facilitate the spreading of the heat from the at least one circuit, the at least one circuit is embedded in a sheet material with high thermal conductivity. The heated sheet 13 is attached to the underside (i.e. the side facing the bottom portion 15) of the top portion 12 of the tray 2. This may be achieved by gluing or by use of other adhesives such as tape. The heated sheet 13 is configured to the heat the central recessed portion 8 and at least a part of the inclined edge portion 7 to avoid freezing of condensate. The heating temperature of the heated sheet 13 may be in the range 3° C. to 8° C., more preferably approximately 5° C. This may be regulated by the provision of at least one thermostat 18 to the heated sheet 13. The at least one thermostat may be a mechanical thermostat, such as a bimetal thermostat 18, or an electronic thermostat 18, for instance a digital electronic thermostat. The sheet may for instance comprise two heating circuits and two thermostats 18, arranged such that a first thermostat controls a first circuit and a second thermostat controls a second circuit. The first thermostat being arranged to activate the first heating circuit when the temperature drops below approximately +3° C. and the second thermostat being arranged to activate the second heating circuit when the temperature drops below approximately −8° C.

Furthermore, the hollow portion 16 is adapted and dimensioned such that when both the electrically heated sheet 13 and the insulating sheet 14 are arranged within the hollow portion 16, they are spaced apart such that the heated sheet 13 does not contact the insulating sheet 14. Thus an intermediate layer of air, between the heated sheet 13 and the insulating sheet 14, will further improve the insulating properties of the tray 2.

The top 12 and bottom 15 portions of the tray 2 are preferably made out of a polymer material, such as ABS/PMMA plastic or similar materials. Using a polymer as the material of the tray 2 further improves the thermal insulation in relation to metallic materials.

It should be mentioned that the inventive concept is by no means limited to the embodiments described herein, and several modifications are feasible without departing from the scope of the invention as defined in the appended claims. For instance, the dimensions of the tray may be adapted to various heat pumps, and the shape and positions of the recessed portions may be adapted to dimensions of supporting members on various supports.

The invention claimed is:

1. A drainage tray for collecting condensate from a heat pump, the heat pump being adapted to be mounted on a support, the support being mountable to at least one supporting structure to carry the weight of the heat pump and the support, the drainage tray comprising:

a peripheral edge portion defining a central recessed portion configured to collect condensate;

a condensate outlet for removing the condensate from the tray;

wherein the drainage tray is configured to be arranged between an underside of the heat pump and the support;

at least two lateral recessed portions on opposite sides of the drainage tray in relation to the central recessed portion; and wherein the lateral recessed portions correspond to supporting members on the support, such that the drainage tray is supported by the contact between the at least two lateral recessed portions and the support.

2. The drainage tray according claim 1, further comprising a rubber coating covering at least a part of the at least two lateral recessed portions for increasing friction between the tray and the support.

3. The drainage tray according to claim 1, wherein a first of the lateral recessed portions is adapted for restricting motion of the drainage tray in two directions; and wherein a second of the lateral recessed portions is adapted for restricting motion of the drainage tray in one direction.

4. The drainage tray according to claim 1, wherein the drainage tray has a trapezoidal shape.

5. The drainage tray according to claim 1, further comprising a top tray portion and a bottom tray portion that are connected together along a peripheral edge of the drainage tray;

wherein a hollow portion is formed within the drainage tray between the top and the bottom tray portions.

6. The drainage tray according to claim 5, further comprising an electrically heated sheet arranged within the hollow portion;

wherein the electrically heated sheet is attached to an underside of the top tray portion.

7. The drainage tray according to claim 5, further comprising an insulating sheet arranged within the hollow portion;

wherein the insulating sheet is attached to a top side of the bottom tray portion.

8. The drainage tray according to claim 5, further comprising:

an electrically heated sheet attached to an underside of the top tray portion; and an insulating sheet attached to a top side of the bottom tray portion;

wherein the insulating sheet and the electrically heated sheet are arranged within the hollow portion and spaced apart such that an intermediate air layer is situated between the insulating sheet and the electrically heated sheet.

9. The drainage tray according to claim 1, wherein the drainage tray is made from a polymer material.

10. The drainage tray according to claim 1, further comprising a hose connected to the condensate outlet of the drainage tray;

wherein the hose is insulated and configured to be heated.

11. The drainage tray according to claim 1, wherein the central recessed portion is configured to hold at least a volume of 1.2 liters of condensate.

12. The drainage tray according to claim 1, wherein the drainage tray has a height of between 20 and 30 mm.

13. A heat pump system comprising:

the heat pump;

the support; and the drainage tray according to claim 1;

wherein the heat pump is arranged on the support via bushings having a height of between 25 and 40 mm;

wherein the bushings create a space between the underside of the heat pump and the support; and wherein the space receives the drainage tray.

14. A drainage tray for collecting condensate from a heat pump, the heat pump being adapted to be mounted on a support, the support being mountable to at least one supporting structure to carry the weight of the heat pump and the support, the drainage tray comprising: a peripheral edge portion defining a central recessed portion configured to collect condensate; a condensate outlet for removing the condensate from the tray; wherein the drainage tray is configured to be arranged between an underside of the heat pump and the support; wherein the drainage tray has a trapezoidal shape; at least two lateral recessed portions on opposite sides of the drainage tray in relation to the central recessed portion; and wherein the lateral recessed portions correspond to supporting members on the support, such that the drainage tray is supported by the contact between the at least two lateral recessed portions and the support.

15. A heat pump system comprising:

the heat pump;

the support; and the drainage tray according to claim 14;

wherein the heat pump is arranged on the support via bushings having a height of between 25 and 40 mm;

wherein the bushings create a space between the underside of the heat pump and the support; and wherein the space receives the drainage tray.

16. The drainage tray according to claim 14, further comprising a top tray portion and a bottom tray portion that are connected together along a peripheral edge of the drainage tray;

wherein a hollow portion is formed within the drainage tray between the top and the bottom tray portions.

17. The drainage tray according to claim 16, further comprising an electrically heated sheet arranged within the hollow portion;

wherein the electrically heated sheet is attached to an underside of the top tray portion.

18. The drainage tray according to claim 16, further comprising an insulating sheet arranged within the hollow portion;

wherein the insulating sheet is attached to a top side of the bottom tray portion.

19. The drainage tray according to claim 16, further comprising:

an electrically heated sheet attached to an underside of the top tray portion; and an insulating sheet attached to a top side of the bottom tray portion;

wherein the insulating sheet and the electrically heated sheet are arranged within the hollow portion and spaced apart such that an intermediate air layer is situated between the insulating sheet and the electrically heated sheet.

20. The drainage tray according to claim 14, wherein the drainage tray is made from a polymer material.

21. The drainage tray according to claim 14, further comprising a rubber coating covering at least a part of the at least two lateral recessed portions for increasing friction between the tray and the support.

22. The drainage tray according to claim 14, wherein a first of the lateral recessed portions is adapted for restricting motion of the drainage tray in two directions; and wherein a second of the lateral recessed portions is adapted for restricting motion of the drainage tray in one direction.

* * * * *